US007341070B1

(12) United States Patent
Wallace

(10) Patent No.: US 7,341,070 B1
(45) Date of Patent: Mar. 11, 2008

(54) SHELTER SUPPORT AND METHOD

(76) Inventor: Larry D. Wallace, 6819 S. K St., Tacoma, WA (US) 98408

( * ) Notice: Subject to any disclaimer, the term of this patent is extended or adjusted under 35 U.S.C. 154(b) by 65 days.

(21) Appl. No.: 11/340,776

(22) Filed: Jan. 27, 2006

(51) Int. Cl.
*F16M 11/38* (2006.01)
*E04H 15/58* (2006.01)
*E04H 15/34* (2006.01)
*E04H 15/48* (2006.01)

(52) U.S. Cl. ..... 135/117; 248/188.6; 135/121; 135/151

(58) Field of Classification Search ..... 135/138, 135/87, 221, 139, 151, 153, 114, 117, 121; 248/188.8, 188.9; 403/76; 52/298
See application file for complete search history.

(56) References Cited

U.S. PATENT DOCUMENTS 590,636 A * 9/1897 Walters ..... 248/181.1
765,984 A * 7/1904 Morris et al. ..... 135/84
1,179,391 A * 4/1916 Bachman ..... 182/204
1,846,011 A * 2/1932 Adams ..... 135/158
3,006,673 A * 10/1961 Swick ..... 403/133
3,099,103 A 7/1963 Wright
4,073,454 A 2/1978 Sauber
4,766,976 A 8/1988 Wallick, Jr.
5,494,333 A 2/1996 Wilson
D373,428 S 9/1996 Nashleanas et al.
6,520,459 B2 2/2003 Burr
6,572,061 B2 6/2003 Overbeck
6,591,849 B1 * 7/2003 Swetish et al. ..... 135/140
6,772,780 B2 * 8/2004 Price ..... 135/131

* cited by examiner

*Primary Examiner*—David Dunn
*Assistant Examiner*—Kaitlin A Wilson

(57) ABSTRACT

A shelter support includes a canopy and four legs each attached to and extending downwardly from the canopy. Each of the legs has an open bottom end. A plurality of couplers is provided and each is configured to releasably attach one of the legs to a ground support surface. Each of the couplers is rotatably coupled to one of the legs. Each of the couplers is configured for selectively adjusting a height of a corresponding one of the legs with respect to the ground support surface. The plurality of couplers includes four couplers.

8 Claims, 3 Drawing Sheets

SHELTER SUPPORT AND METHOD

BACKGROUND OF THE INVENTION

1. Field of the Invention

The present invention relates to support devices and more particularly pertains to a new support device for easily attaching and supporting a canopy type shelter to a ground support surface so that the canopy may be used for a bus shelter.

2. Description of the Prior Art

The use of support devices is known in the prior art. U.S. Pat. No. 4,766,976 describes a device for supporting and leveling a leg of a ladder. Another type of support device is U.S. Pat. No. 4,073,454 includes a pad for an outrigger to support and level an outrigger. Yet another support device is found in U.S. Pat. No. 6,520,459 which includes a bottom panel having a well extending therein for receiving a leg having a spherically shaped end to allow for easily leveling of the leg. Still yet another such device is found in U.S. Pat. No. 6,572,061.

While these devices fulfill their respective, particular objectives and requirements, the need remains for a device that allows for easy installation of shelter on uneven terrain. The device should include supports that allow for easy adjustment of the legs of a support as well as ensure that the legs are fully secured to the terrain.

SUMMARY OF THE INVENTION

The present invention meets the needs presented above by generally comprising a canopy and four legs each attached to and extending downwardly from the canopy. Each of the legs has an open bottom end. A plurality of couplers is provided and each is configured to releasably attach one of the legs to a ground support surface. Each of the couplers is rotatably coupled to one of the legs. Each of the couplers is configured for selectively adjusting a height of a corresponding one of the legs with respect to the ground support surface. The plurality of couplers includes four couplers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
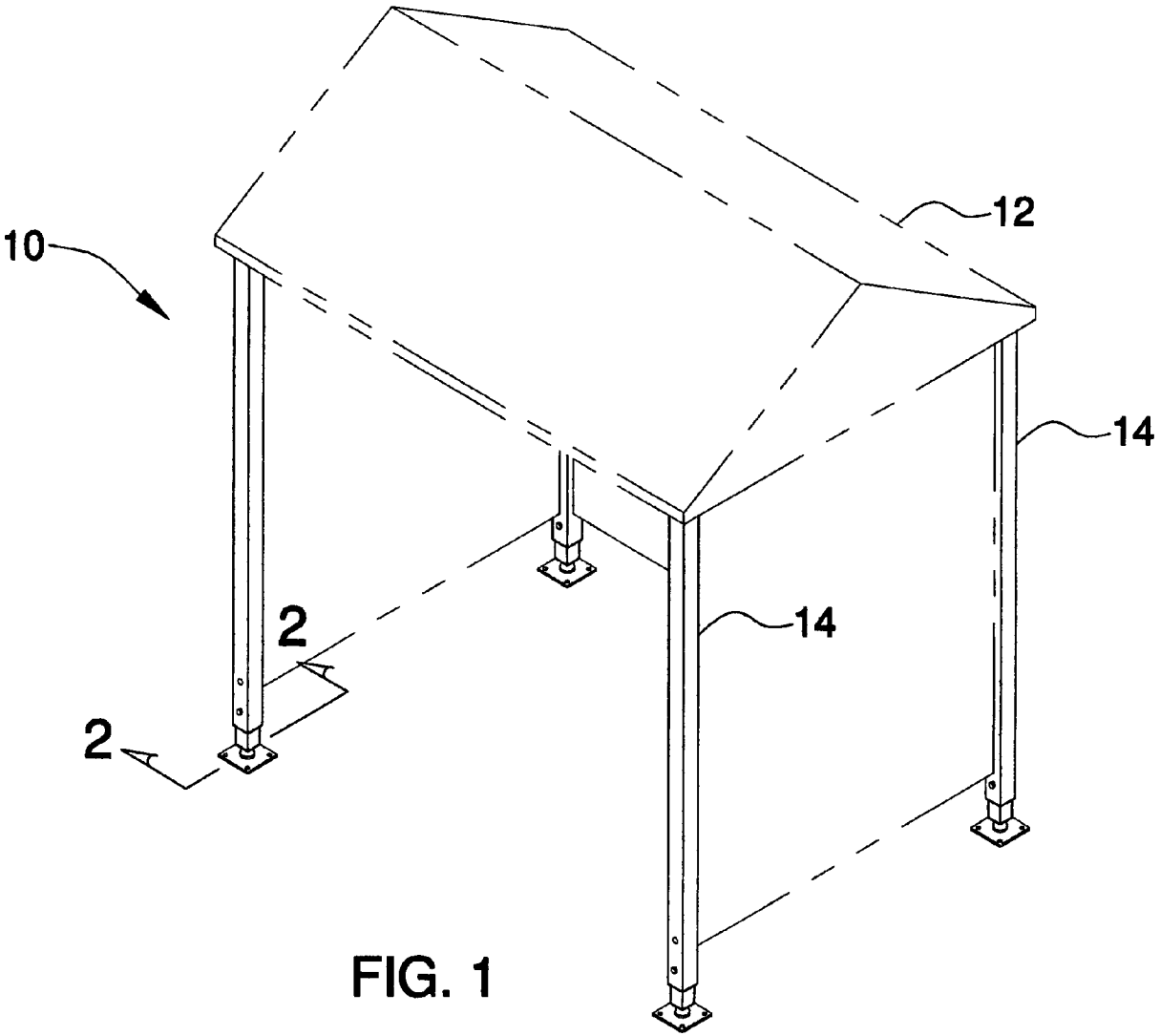
FIG. 1 is a perspective view of a shelter support and method according to the present invention.
Figure 3:
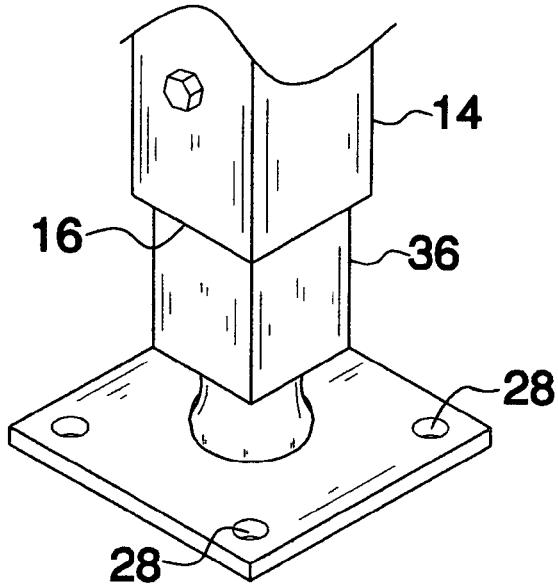
FIG. 3 is a perspective view of the present invention.
Figure 2:
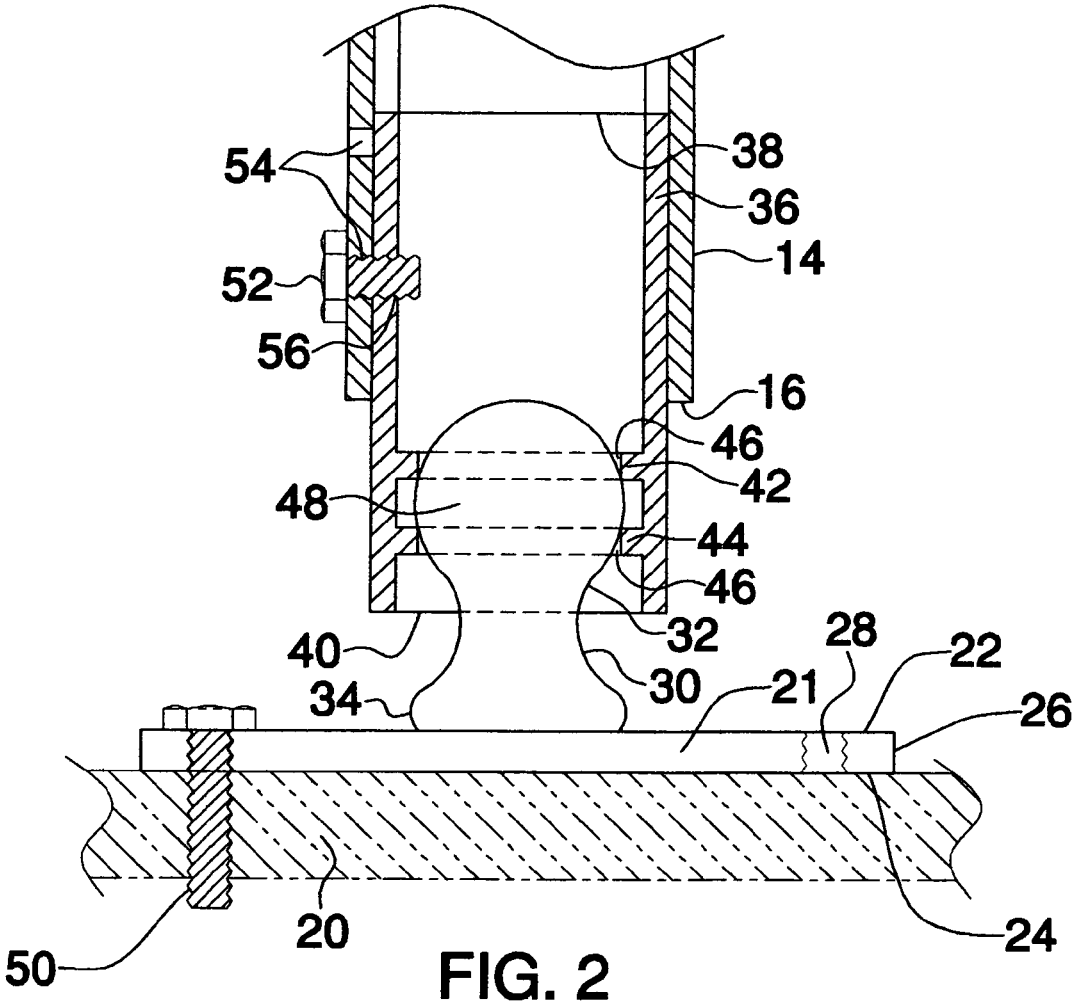
FIG. 2 is a cross-sectional view taken along line 2-2 of FIG. 1 of the present invention.
Figure 4:
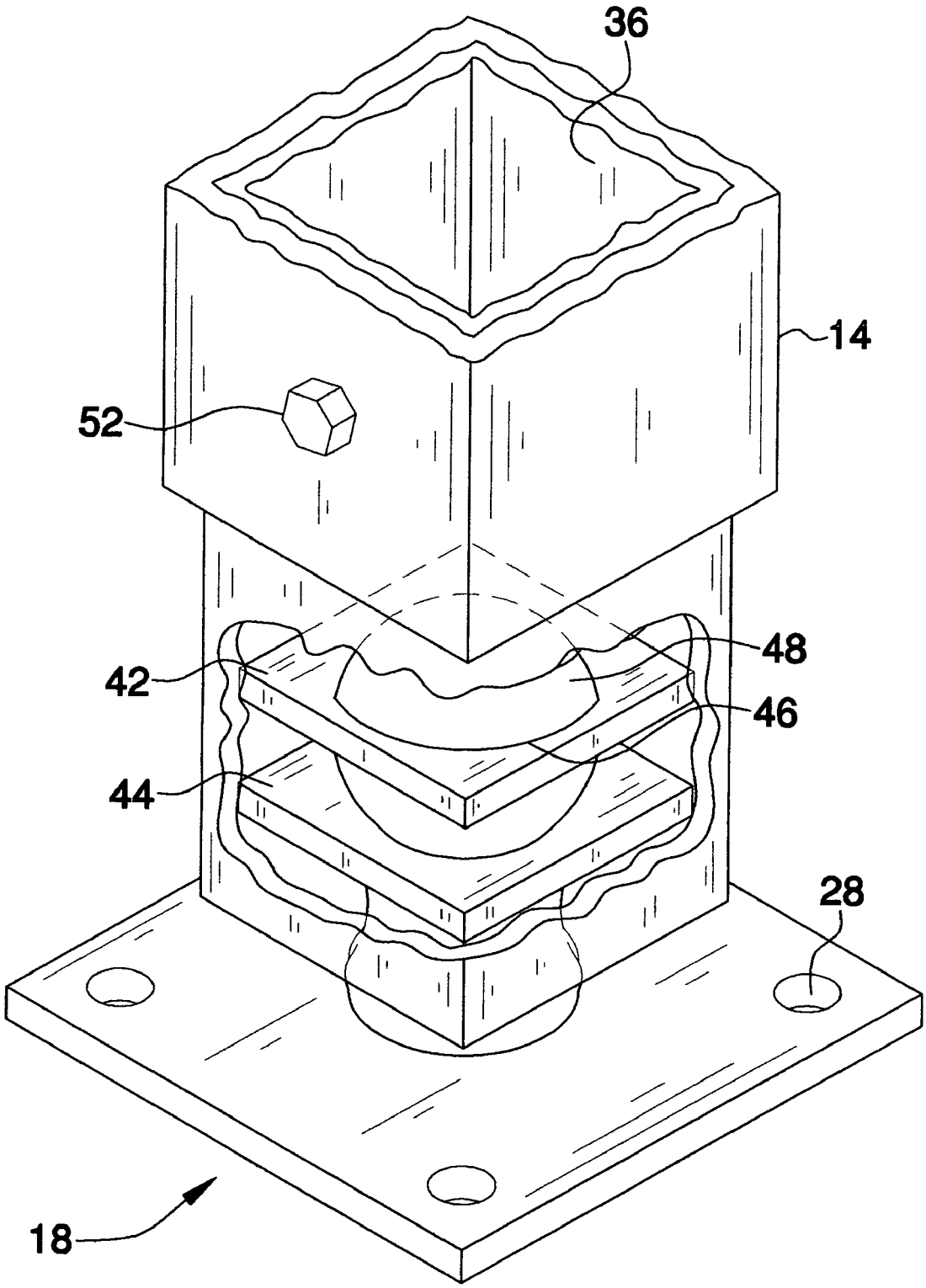
FIG. 4 is a broken perspective view of the present invention.

With reference now to the drawings, and in particular to FIGS. 1 through 4 thereof, a new support device embodying the principles and concepts of the present invention and generally designated by the reference numeral 10 will be described.

As best illustrated in FIGS. 1 through 4, the shelter support and method 10 generally comprises providing a generally conventional canopy 12. Four legs 14 are attached to and extend downwardly from the canopy 12. Each of the legs 14 has an open bottom end 16.

A plurality of couplers 18 is provided. Each of the couplers 18 is configured to releasably attach one of the legs 14 to a ground support surface 20. Each of the couplers 18 is rotatably coupled to one of the legs 14. The couplers 18 are configured for selectively adjusting a height of the leg 14 with respect to the ground support surface 20. The plurality of couplers 18 includes four couplers.

Each of the couplers 18 comprises a panel 21 having a top side 22, a bottom side 24 and a peripheral edge 26. The panel 21 has a plurality of apertures 28 extending therethrough. Each of the apertures 28 is positioned adjacent to the peripheral edge 26. A post 30 has an upper end 32 and a lower end 34. The lower end 34 is attached to the top side 22 so that the post 30 extends vertically away from the top side 22. A tube 36 has a first end 38 and a second end 40. The tube 36 has an upper plate 42 and a lower plate 44 mounted therein. The upper 42 and lower 44 plates are orientated parallel to each other. Each of the upper 42 and lower 44 plates has an opening 46 extending therethrough. The openings 46 are aligned with each other. The first end 38 of the tube 36 is removably extendable into one of the bottom ends 16 of the legs 14. A ball 48 is attached to the upper end 32 of the post 30. The ball 48 has a larger diameter than the openings 46 in the upper 42 and lower 44 plates and is positioned between the upper 42 and lower 44 plates. The ball 48 extends into each of the openings 46.

A plurality of elongated fasteners 50 is provided. Each of the fasteners 50 is removably extendable through one of the apertures 28 and into the ground support surface 21. A plurality of securing members 52 is also provided. Each of the securing members 52 is removably extendable through one of the legs 14 and into one of the tubes 36 above a corresponding one of the upper plates 42. The securing members 52 may be extended through one of a plurality of first holes 54 extending through the legs 14 and into a second hole 56 extending through the tube 36. This allows a person to adjust the height of the legs 14 to compensate for an uneven ground support surface 20.

In use, each of the panels 21 is positioned so that each of the posts 30 is alignable with one of the legs 14. The panels 21 are attached to the ground support surface 20 and each of the couplers 18 is extended into one of the lower ends 16. Each of the fasteners 52 is then extended through one of the legs 14 and above a corresponding one of the upper plates 42 so that each of the couplers 18 is attached to one of the legs 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shelter apparatus comprising:

a canopy, four legs being attached to and extending downwardly from said canopy, each of said legs having an open bottom end;

a plurality of couplers each configured to releasably attach one of said legs to a ground support surface, each of said couplers being rotatably coupled to one of said legs, said plurality of couplers including four couplers, each of said couplers being configured for selectively adjusting a height of a corresponding one of said legs with respect to said ground support surface, wherein each of said couplers comprises;

a panel having a top side, a bottom side and a peripheral edge, said panel having a plurality of apertures extending therethrough, each of said apertures being positioned adjacent to said peripheral edge, each of said fasteners extending through one of said apertures;

a post having an upper end and a lower end, said lower end being attached to said top side such that said post extending vertically away from said top side;

a tube having a first end and a second end, said tube having an upper plate and a lower plate mounted therein, said upper and lower plates being orientated parallel to each other, each of said upper and lower plates having an opening extending therethrough, said openings being aligned with each other, said first end of said tube being removably extendable into one of said bottom ends of said legs; and a ball being attached to said upper end of said post, said ball having a larger diameter than said openings in said upper and lower plates, said ball being positioned between said upper and lower plates and extending into each of said openings.

2. The apparatus according to claim 1, further including a plurality of elongated fasteners, each of said fasteners being removably extendable through one of said couplers and into said ground support surface.

3. The apparatus according to claim 1, further including a plurality of securing members, each of said securing members being removably extendable through one of said legs and into one of said couplers.

4. The apparatus according to claim 1, further including a plurality of elongated fasteners, each of said fasteners being removably extendable through one of said apertures and into said ground support surface.

5. The apparatus according to claim 4, further including a plurality of securing members, each of said securing members being removably extendable through one of said legs and into one of said tubes above a corresponding one of said upper plates.

6. The apparatus according to claim 1, further including a plurality of securing members, each of said securing members being removably extendable through one of said legs and into one of said tubes above a corresponding one of said upper plates.

7. A shelter apparatus comprising:

a canopy, four legs being attached to and extending downwardly from said canopy, each of said legs having an open bottom end;

a plurality of couplers each configured to releasably attach one of said legs to a ground support surface, each of said couplers being rotatably coupled to one of said legs, said plurality of couplers including four couplers, each of said couplers being configured for selectively adjusting a height of a corresponding one of said legs with respect to said ground support surface, each of said couplers comprising;

a panel having a top side, a bottom side and a peripheral edge, said panel having a plurality of apertures extending therethrough, each of said apertures being positioned adjacent to said peripheral edge;

a post having an upper end and a lower end, said lower end being attached to said top side such that said post extending vertically away from said top side;

a tube having a first end and a second end, said tube having an upper plate and a lower plate mounted therein, said upper and lower plates being orientated parallel to each other, each of said upper and lower plates having an opening extending therethrough, said openings being aligned with each other, said first end of said tube being removably extendable into one of said bottom ends of said legs;

a ball being attached to said upper end of said post, said ball having a larger diameter than said openings in said upper and lower plates, said ball being positioned between said upper and lower plates and extending into each of said openings;

a plurality of elongated fasteners, each of said fasteners being removably extendable through one of said apertures and into said ground support surface;

a plurality of securing members, each of said securing members being removably extendable through one of said legs and into one of said tubes above a corresponding one of said upper plates.

8. A method of supporting a shelter, said method comprising the steps of:

providing a canopy, four legs being attached to and extending downwardly from said canopy, each of said legs having an open bottom end;

providing a plurality of couplers each configured to releasably attach one of said legs to a ground support surface, each of said couplers being rotatably coupled to one of said legs, said plurality of couplers including four couplers, each of said couplers being configured for selectively adjusting a height of a corresponding one of said legs with respect to said ground support surface, each of said couplers comprising;

a panel having a top side, a bottom side and a peripheral edge, said panel having a plurality of apertures extending therethrough, each of said apertures being positioned adjacent to said peripheral edge;

a post having an upper end and a lower end, said lower end being attached to said top side such that said post extending vertically away from said top side;

a tube having a first end and a second end, said tube having an upper plate and a lower plate mounted therein, said upper and lower plates being orientated parallel to each other, each of said upper and lower plates having an opening extending therethrough, said openings being aligned with each other, said first end of said tube being removably extendable into one of said bottom ends of said legs;

a ball being attached to said upper end of said post, said ball having a larger diameter than said openings in said upper and lower plates, said ball being positioned between said upper and lower plates and extending into each of said openings;

providing a plurality of elongated fasteners, each of said fasteners being removably extendable through one of said apertures and into said ground support surface;

providing a plurality of securing members, each of said securing members being removably extendable through one of said legs and into one of said tubes above a corresponding one of said upper plates;

positioning each of said panels such that each of said posts is alignable with one of said legs;

attaching each of said panels to the ground support surface;

extending each of said couplers into one of said lower ends; and extending each of said fasteners through one of said legs and above a corresponding one of said upper plates wherein each of said couplers is attached to one of said legs.

* * * * *